US005097945A

United States Patent [19]

Brooks

[11] Patent Number: 5,097,945

[45] Date of Patent: Mar. 24, 1992

[54] METHOD FOR SAFE PACKAGING OF SHAPED CHARGES FOR TRANSPORT

[75] Inventor: James E. Brooks, Manvel, Tex.

[73] Assignee: Schlumberger Technology Corporation, Houston, Tex.

[21] Appl. No.: 626,346

[22] Filed: Dec. 12, 1990

[51] Int. Cl.[5] ..... F42B 39/14

[52] U.S. Cl. ..... 206/3; 53/446; 53/473

[58] Field of Search ..... 53/441, 446, 475, 542, 53/473; 206/3, 515

[56] References Cited

U.S. PATENT DOCUMENTS

| | | | |
|---|---|---|---|
| 2,142,227 | 1/1939 | Whiteside | 206/3 |
| 2,660,300 | 11/1953 | Pauls | 206/3 |
| 2,877,891 | 3/1959 | Chartrand | 206/3 |
| 3,424,298 | 1/1969 | Wallace | 206/3 |

FOREIGN PATENT DOCUMENTS

| | | | |
|---|---|---|---|
| 503358 | 4/1939 | United Kingdom | 53/446 |

*Primary Examiner*—John Sipos

*Attorney, Agent, or Firm*—Henry N. Garrana; John H. Bouchard

[57] ABSTRACT

A new method for safe packaging of shaped charges within a shipping box for transport includes arranging a plurality of shaped charges in rows, each row including at least four shaped charges, two of the at least four shaped charges disposed adjacent one another and pointing in one direction and two additional ones disposed adjacent one another and not pointing in the one direction. The two additional ones may point in a direction opposite to the one direction. In another embodiment of the invention, each row includes at least six charges, three disposed adjacent one another and pointing in one direction and three disposed adjacent one another and not pointing in the one direction.

3 Claims, 2 Drawing Sheets

FIG. 1
(PRIOR ART)
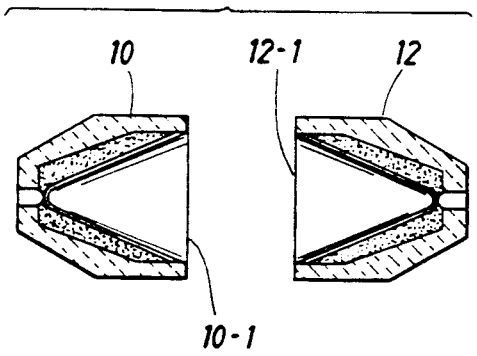
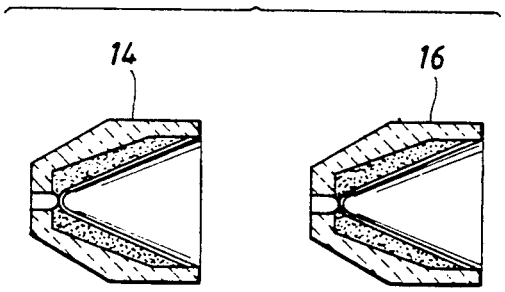
FIG. 2
FIG. 3
(PRIOR ART)
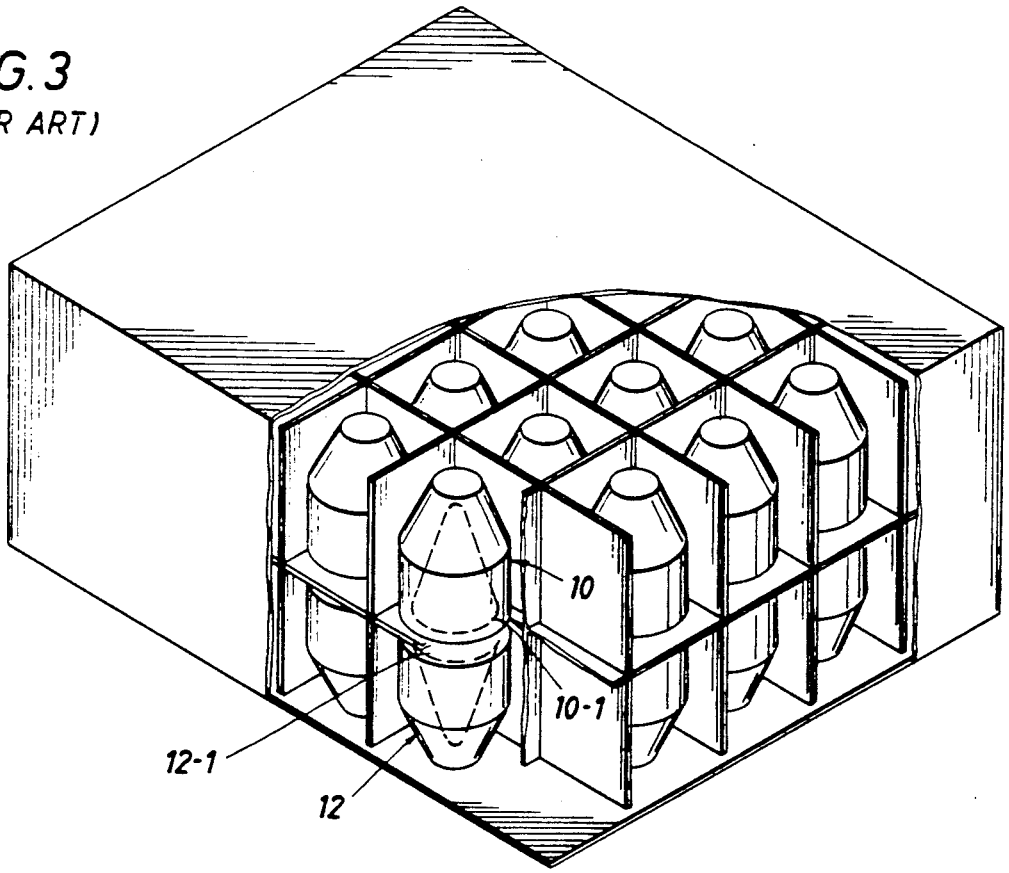

METHOD FOR SAFE PACKAGING OF SHAPED CHARGES FOR TRANSPORT

BACKGROUND OF THE INVENTION

The subject matter of the present invention relates to a new method for safely packaging shaped charges for transportation by common carrier.

If a box of commercial oil-well shaped charges must be transported by common airline carrier, the box of shaped charges must be certified "class C" by a competent authority, such as the Department of Transportion. In accordance with one of the certification requirements, if a shaped charge in a shipping box should accidentally detonate, the jet produced therefrom must not propagate outside of the shipping box. This is normally accomplished by packaging the charges in a pairwise fashion, as shown in FIG. 1, so that the jet from the detonated shaped charge is destroyed by the induced detonation and subsequent liner collapse of the opposing shaped charge. It is important that the shaped charges be arranged as in FIG. 1 and not as in FIG. 2, since otherwise the first shaped charge would merely detonate the second shaped charge and cause propagation of a second jet. The problem with the arrangement shown in FIG. 1, however, is that some shaped charge designs produce jets which are sufficiently long, fast, and coherent enough to penetrate the adjacent mirror-imaged shaped charge, thus potentially exiting the shipping box; that is, the jet may be powerful enough so that some of it will pass through the destructive influence of the explosive detonation and through the collapse of the adjacent shaped charge. If this happens, the jet may endanger structures or persons present within the immediate vicinity of the shipping box. A severe safety hazard is created.

SUMMARY OF THE INVENTION

Accordingly, it is a primary object of the present invention to provide a safe packaging method for packaging shaped charges in a shipping box during transportion of the box aboard a common carrier, which method will prevent jets developed from even the most powerful shaped charges in the box from exiting the shipping box during transport.

It is a further object of the present invention to provide a safe packaging method wherein the shaped charges are arranged in rows within the shipping box, each row of shaped charges including at least a first two charges pointing in one direction and at least a second two further charges disposed adjacent the first two charges and pointing in a direction opposite the one direction.

It is a further object of the present invention to provide a safe packaging method wherein the shaped charges are arranged in rows within the shipping box, each row of shaped charges including at least a first two charges pointing in one direction and at least a second two further charges disposed adjacent the first two charges, one of the second two charges pointing in a direction opposite the one direction, the other of the second two charges pointing in a direction which is disposed at an angle "theta" from the one direction.

In accordance with these and other objects of the present invention, a plurality of shaped charges are serially arranged in rows within the shipping box, the plurality including at least a first two charges pointing in one direction and at least a second two charges disposed adjacent to the first two charges; in one embodiment, the second two charges are pointing in a direction opposite to the one direction; in another embodiment, one of the second two charges point in a direction opposite to the one direction, the other of the second two charges pointing in a direction which is disposed at an angle "theta" from the one direction. A shaped charge is "pointing" in a particular direction when an open end of the charge is directed in the particular direction. As a result, if any charge, which points in a particular direction, detonates, and a jet is produced therefrom, the jet must propagate through at least two other charges, if not through three other charges, which are not pointed in the same "particular direction" thereby preventing the jet from successfully exiting the shipping box and endangering persons and structures present within the environment surrounding the shipping box.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 1 illustrates a prior art packaging method for packaging shape charges in a shipping box;

FIG. 2 illustrates an incorrect packaging method;

FIG. 3 illustrates a three-dimensional view of a shipping box utilizing the prior art packaging method of FIG. 1, the shaped charges being arranged in columns and packaged in accordance with the prior art packaging method;

DETAILED DESCRIPTION OF THE PREFERRED EMBODIMENT

Figure 4:
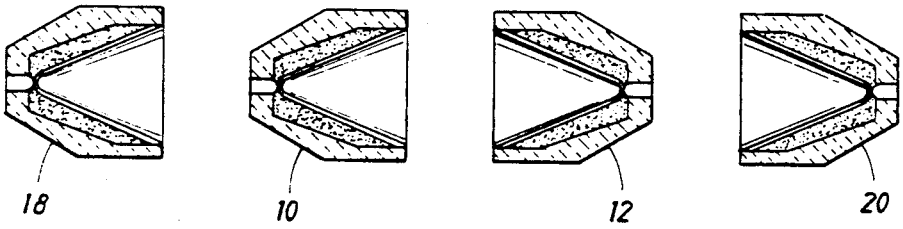
FIG. 4 illustrates a packaging method in accordance with the present invention for packaging shaped charges in a shipping box.

Referring to FIG. 1, a prior art method for packaging shaped charges in a shipping box for transport is illustrated.

Government authorities require shaped charges, which are adapted for use in a perforating gun, to be carefully packaged in shipping boxes prior to transport by common carrier from one location to another. This packaging is required in order to prevent an accidental detonation of a shaped charge in the box from endangering persons or structures in the immediate vicinity of the shipping box. For example, if a shaped charge detonates, the jet produced from the charge may exit the box and detonate or ignite other surrounding structures present within the carrier. Therefore, government authorities require that the shaped charges be packaged within the shipping box in a specific manner which will prevent the jet, produced from an accidentally detonated shaped charge, from exiting the box. FIG. 1 is a prior art packaging method wherein a first shape charge 10 has an open end 10-1 which faces an open end 12-1 of a second shaped charge 12. In operation, if the first shaped charge 10 detonates, the second shaped charge 12 will theoretically absorb the jet produced from the first shaped charge 10.

FIG. 2 is an example of how not to package shaped charges within a shipping box during transport. In FIG. 2, charges 14 and 16 point in the same direction. If both charges point in the same direction, an accidental detonation of one charge 14 will initiate detonation of the adjacent charge 16 with its subsequent jet exiting the shipping box. As shown in FIG. 1, the first and second charges 10 and 12 must face each other, so that one charge will tend to absorb the jet produced from the other charge.

FIG. 3 illustrates the prior art packaging method of FIG. 1 disposed in a prior art shipping box. The first shaped charge 10 has its open end 10-1 facing the open end 12-1 of the second shaped charge 12, as shown in FIG. 1; the first and second shaped charges 10 and 12 are arranged in a plurality of columns within the box.

However, there is a problem associated with the packaging arrangement of FIGS. 1 and 3; that is, some shaped charge designs produce jets which are long, fast and coherent enough to pass through the destructive influence of the explosive detonation and through the adjacent shaped charge. When this happens, the jet may exit the shipping box and endanger surrounding persons or structures. Therefore, the prior art packaging method of FIGS. 1 and 3 is insufficient to prevent an accident during transport of the shipping box aboard a carrier.

Another packaging method is needed, when packing shaped charges within a shipping box, to prevent a jet, produced from an accidentally detonated shaped charge in the shipping box, from exiting the box and detonating shaped charges disposed in other boxes and/or endangering surrounding persons or structures.

Referring to FIG. 4, a packaging method in accordance with the present invention is illustrated for packaging shaped charges in a shipping box.

Figure 5:
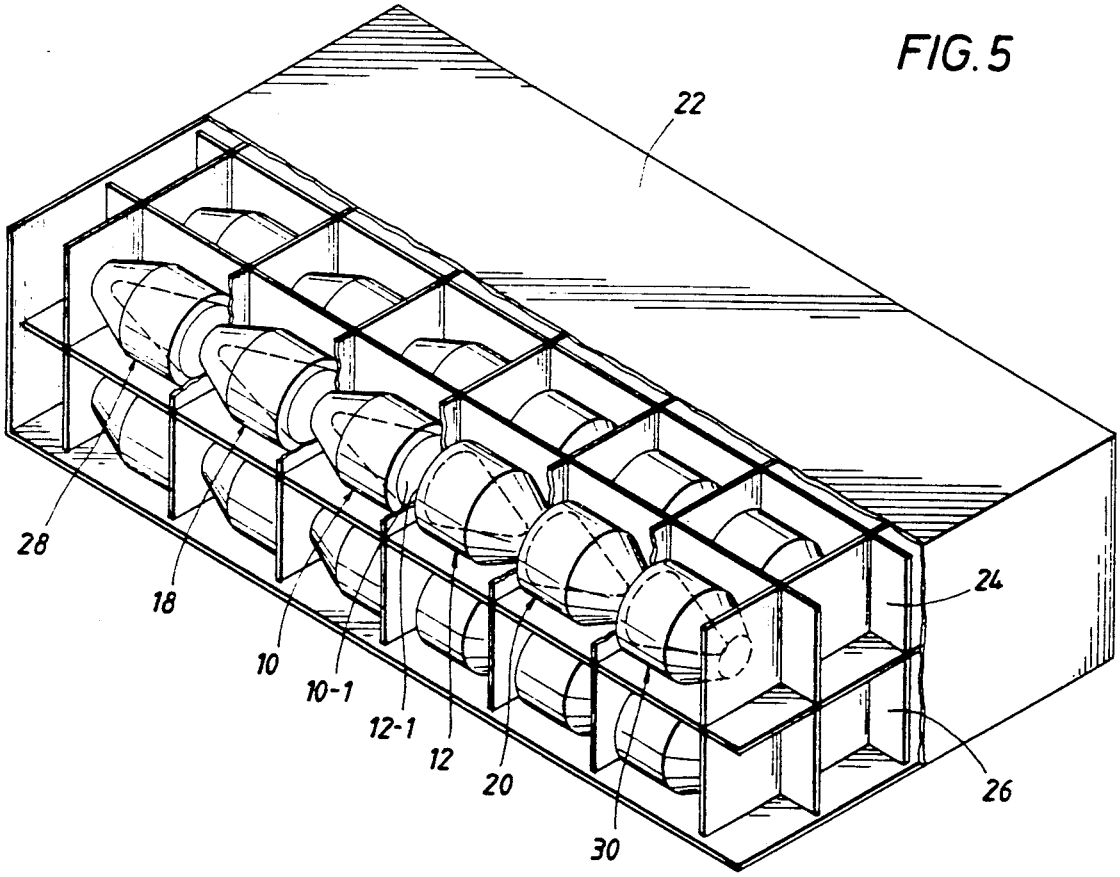
FIG. 5 illustrates a three-dimensional view of a shipping box utilizing the packaging method of FIG. 4 in accordance with the present invention, the shape charges being arranged in rows and packaged in accordance with the new packaging method.

In FIG. 4, the first shaped charge 10 and the second shaped charge 12 face each other, as in FIG. 1; however, a third shaped charge 18 is disposed behind the first shaped charge 10, and a fourth shaped charge 20 is disposed behind the second shaped charge 12, the open end of the fourth shaped charge 20 facing the closed end of the second shaped charge 12 and facing the open end of the first and third shaped charges 10 and 18, respectively. Although FIG. 4 illustrates four charges 10, 12, 18 and 20, as shown in FIG. 5, more than four charges may exist for accomplishing the main purpose of this invention; that is, a fifth shaped charge may be disposed behind the third shaped charge 18 and a sixth shaped charge may be disposed behind the second shaped charge 12. This concept is illustrated in FIG. 5.

Referring to FIG. 5, a three-dimensional view of a shipping box utilizing the packaging method of FIG. 4 in accordance with the present invention is illustrated, the shaped charges being arranged in rows and packaged in accordance with the new packaging method of FIG. 4.

In FIG. 5, the first, second, third and fourth shaped charges 10, 12, 18 and 20, respectively, of FIG. 4, are arranged in rows (not columns) within a shipping box 22. For example, a t op part 24 of the box 22 includes a plurality of rows and a bottom part 26 of the box 22 includes a plurality of rows, each row in the box 22 including three shaped charges facing in one direction and three shaped charges facing in a direction opposite to the one direction. As shown in FIG. 4, the first and third shaped charges 10 and 18, respectively, face in one direction and second and fourth shaped charges 12 and 20, respectively, face in a direction opposite to the one direction. However, in each row of FIG. 5, a fifth shaped charge 28 is disposed behind the third shaped charge 18 and faces in the one direction, and a sixth shaped charge 30 is disposed behind the fourth shaped charge 20 and faces in the direction opposite to the one direction. The open end 10-1 of the first shaped charge 10 faces or points in the one direction, and the open end 12-1 of the second shaped charge 12 faces or points in the direction opposite to the one direction.

In operation, referring to FIG. 5, if the first shaped charge 10 accidentally detonates, the jet produced from the charge 10 must pass through three other shaped charges, the second, fourth, and sixth shaped charges 12, 20, and 30, respectively. Although the jet from the charge 10 may conceivably pass through the second charge 12, it cannot also pass through the fourth and sixth shaped charges 20 and 30, respectively and exit the shipping box 22. Therefore, since the jet from the first shaped charge 10 cannot pass through the sixth shaped charge 30 and exit the shipping box 22, if the third and/or fifth shaped charges 18 and 28 accidentally detonate, the jets from these charges also cannot pass through the sixth shaped charge 30 and exit the shipping box 22. The same may be said with respect to the jets from shaped charges 12, 20 and 30; if charge 12 accidentally detonates, the jet produced therefrom may conceivably pass through charge 10, but it will not also pass through charge 18, let alone through both charges 18 and 28; as a result, the jet will not exit the shipping box 22; furthermore, if charges 20 or 30 accidentally detonate, the jets produced therefrom may detonate charge 12, but, as notes above, the jet from charge 12 cannot pass through both charges 10 and 18, let alone through all three charges 10, 18, and 28. Therefore, if any shaped charge in the shipping box 22 accidentally detonates, the jet produced from the charge cannot and will not exit the shipping box 22 and endanger any structures (e.g., transport aircraft) or persons present within the immediate vicinity of the shipping box.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method of packaging shaped explosive charges in a shipping container, comprising the steps of:

disposing at least four shaped explosive charges axially aligned with respect to one another in said shipping container, said charges having a pointing direction in which any explosive force therefrom is directed or shaped, a first pair of said at least four charges being disposed adjacent to one another, axially aligned with respect to each other, said first pair of charges pointing in a first direction toward a central axis of said container, and a second pair of said at least four charges being disposed adjacent to one another, axially aligned with respect to each other and with said first pair of charges and pointing toward said central axis of said container so as to oppose an explosive force from either of said first pair of charges.

2. A method of packaging shaped explosive charges in a shipping container, comprising the steps of:

disposing a first plurality of shaped explosive charges adjacent to and axially in line with each other in said shipping container, each of said first plurality of charges having a pointing direction in which any explosive force therefrom is directed or shaped;

positioning said first plurality of charges such that they have a mutual pointing direction in a first direction toward a central axis of said shipping container;

disposing a second plurality of shaped explosive charges adjacent to and axially in line with each other and with said first plurality of charges, each of said second plurality of charges having a pointing direction in which any explosive force therefrom is directed or shaped; and positioning said second plurality of charges such that they have a mutual pointing direction in a second direction toward said central axis of said container so as to oppose an explosive force from any of said first plurality of charges.

3. A container of shaped explosive charges comprising:

a shipping container;

a first plurality of shaped explosive charges adjacent to and axially in line with each other in said shipping container, each of said charges having a pointing direction in which any explosive force therefrom is directed or shaped, said first plurality of charges being positioned such that they have a mutual pointing direction in a first direction toward a central plane of said shipping container; and a second plurality of shaped explosive charges adjacent to and axially in line with each other and with said first plurality of charges, each of said second plurality of charges having a pointing direction in which any explosive force therefrom is directed or shaped, said second plurality of charges being positioned such that they have a mutual pointing direction in a second direction toward said central plane of said container said second direction being opposite said first direction.

* * * * *